US011143064B2

(12) United States Patent
Zurface et al.

(10) Patent No.: US 11,143,064 B2
(45) Date of Patent: Oct. 12, 2021

(54) ELECTROMAGNETIC LATCH ASSEMBLY WITH FLEXIBLE LATCH PIN COUPLING

(71) Applicant: Eaton Intelligent Power Limited, Dublin (IE)

(72) Inventors: Austin Robert Zurface, Dowling, MI (US); Dale Arden Stretch, Novi, MI (US); Brian Karl Vandeusen, Augusta, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/992,014

(22) Filed: Aug. 12, 2020

(65) Prior Publication Data

US 2021/0047948 A1 Feb. 18, 2021

Related U.S. Application Data

(60) Provisional application No. 62/886,843, filed on Aug. 14, 2019.

(51) Int. Cl.

| | |
|---|---|
| ***F01L 1/18*** | (2006.01) |
| ***F01L 9/20*** | (2021.01) |
| ***F01L 13/00*** | (2006.01) |
| *F01L 9/21* | (2021.01) |

(52) U.S. Cl.

CPC ..... *F01L 9/20* (2021.01); *F01L 1/18* (2013.01); *F01L 13/0005* (2013.01); *F01L 1/185* (2013.01); *F01L 2001/186* (2013.01); *F01L 2009/2148* (2021.01); *F01L 2013/101* (2013.01); *F01L 2820/031* (2013.01)

(58) Field of Classification Search

CPC . F01L 1/185; F01L 2001/186; F01L 13/0005; F01L 2013/101; F01L 2820/031

USPC ..... 123/90.39, 90.41, 90.44

See application file for complete search history.

(56) References Cited

U.S. PATENT DOCUMENTS

| | | | | |
|---|---|---|---|---|
| 3,040,217 | A | 6/1959 | Conrad | |
| 4,203,397 | A | 5/1980 | Soeters, Jr. | |
| 5,544,626 | A | 8/1996 | Diggs et al. | |
| 5,896,076 | A | 4/1999 | van Namen | |
| 6,318,318 | B1 | 11/2001 | Jahr | |
| 6,499,451 | B1 * | 12/2002 | Hendriksma | F01L 1/08 123/90.16 |
| 10,358,951 | B2 | 7/2019 | Liskar et al. | |
| 2017/0183982 | A1 | 6/2017 | Hughes | |

(Continued)

*Primary Examiner* — Jorge L Leon, Jr.
(74) *Attorney, Agent, or Firm* — Paul V. Keller

(57) ABSTRACT

In an electromagnetic latch assembly of a type that includes an armature, an electromagnet operative to actuate the armature, a latch pin, and a rigid metal structure that supports both the electromagnet and the latch pin, the latch pin is attached to the armature through a bendable connection. The electromagnet may be mounted to or housed within the metal structure. The latch pin may protrude from the rigid metal structure and may be guided by the metal structure. The bendable connection couples translation of the armature to translation of the latch pin while allowing the two parts to move independently to some degree. The bendable connection may reduce forces on the armature that could cause the armature to bend or stick. Those forces may result from misalignment between the latch pin and the armature or from the latch pin being driven off axis under load.

20 Claims, 7 Drawing Sheets

(56) References Cited

U.S. PATENT DOCUMENTS

| | | | | |
|---|---|---|---|---|
| 2019/0048766 | A1* | 2/2019 | Jeon | F01L 1/047 |
| 2019/0072011 | A1* | 3/2019 | Cecur | F01L 1/46 |
| 2019/0376420 | A1* | 12/2019 | Elendt | F01L 1/185 |

* cited by examiner

ELECTROMAGNETIC LATCH ASSEMBLY WITH FLEXIBLE LATCH PIN COUPLING

FIELD

The present teachings relate to electromagnetic latch assemblies, particularly electromagnetic latch assemblies suitable for switching and cylinder deactivating rocker arm assemblies used in valvetrains for internal combustion engines.

BACKGROUND

An electromagnetic latch assembly may include a latch pin coupled to an armature that is moved back and forth by operating an electromagnet. In some applications, the load on the latch pin is substantial and may cause the latch pin to tilt to the extent permitted by a bore that holds the latch pin. In a compact design, the latch pin bore is provided by a metal structure that also supports the electromagnet.

SUMMARY

The present teachings relate to an electromagnetic latch assembly of a type that includes an armature, an electromagnet operative to actuate the armature from a first position to a second position, a latch pin, and a rigid metal structure that supports both the electromagnet and the latch pin. The electromagnet may be mounted to or housed within the metal structure. The latch pin may protrude from the rigid metal structure and may be guided by the metal structure. According to the preset teachings, the latch pin is attached to the armature through a bendable connection. The bendable connection couples translation of the armature to translation of the latch pin while allowing the two parts to move independently to some degree. The bendable connection may reduce forces on the armature that could cause the armature to bend or stick. Those forces may result from misalignment between the latch pin and the armature or from the latch pin being driven off axis under load.

In some of these teachings, the rigid metal structure includes a bore that guides the latch pin along a path of translation. In some of these teachings, the armature has a smaller diameter than the latch pin. This structure allows the electromagnet and the armature to be made more compact while maintaining the latch pin's load bearing capacity.

In some of these teachings, the rigid metal structure has a first substructure that guides the latch pin and a separate substructure that guides the armature. In some of these teachings, the first substructure is a bore that guides the latch pin along a path of translation. In some of these teachings, the second substructure is a bore that supports a shell around the electromagnet and the shell guides the armature. If the armature is not guided by the same substructure that guides the latch pin, the alignment between the armature and the latch pin may be subject to variation. In some of these teachings, the rigid metal structure is formed of a single piece of cast or stamped metal. Misalignment may be the result of variations that are within manufacturing tolerances. In some of these teachings, the rigid metal structure is a rocker arm of a rocker arm assembly.

In some of these teachings, the bendable connection limits relative movement between the latch pin and the armature to bending in one direction. In some of these teachings, the latch pin has a load-bearing surface aligned to that one direction. The load bearing surface may be a shelf formed by a relatively flat area at one end of the latch pin. In some of these teachings, the bendable connection is provided by a connecting pin that pivotally connects the latch pin and the armature. In some of these teachings, the armature has an axis of translation and the connecting pin crosses the axis. In some of these teachings, the connecting pin is displaced from that axis. The latch pin may tilt in its bore when placed under load and one or the other of these pin placements may permit that tilting without straining the armature.

In some of these teachings, the bendable connection is formed by a ball and socket. In some of these teachings, the bendable connection is formed by a cable. These types of connections allow multiple degrees of freedom for independent movement between the armature and the latch pin while keeping translation of the latch pin coupled to translation of the armature.

In some of these teachings, the bendable connection and the latch pin are on one side of the electromagnet and there is a plate adjacent an opposite side of the electromagnet. In some of these teachings, the plate supports the armature. In some of these teachings, the armature is sufficiently long that the armature is supported by the plate regardless of whether the latch pin is in the first position or the second position. Supporting the armature at an opposite end of the electromagnet from the bendable connection provides better control over the orientation of the armature than a support point closer to the bendable connection.

In some of these teachings, the electromagnetic latch assembly includes one or more permanent magnets that make the armature position stable in both the first position and the second position. In some of these teachings, the one or more permanent magnets are located between the electromagnet and the armature, but the armature is prevented from contacting the permanent magnets. Preventing the armature from contacting the permanent magnets avoids possible damage to the permanent magnets.

In some of these teaching, the armature includes a ferromagnetic ferrule and a paramagnetic core. The ferrule may mate with a pole piece at a limit of armature travel. The shapes of the mating faces are usually selected to control the way in which force on the armature varies in relationship to armature position. According to the present teachings, the shapes of the mating faces are selected to minimize sticking. Mating faces that minimize sticking may include axially facing flat faces and tapered faces.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

DETAILED DESCRIPTION

Figure 1:
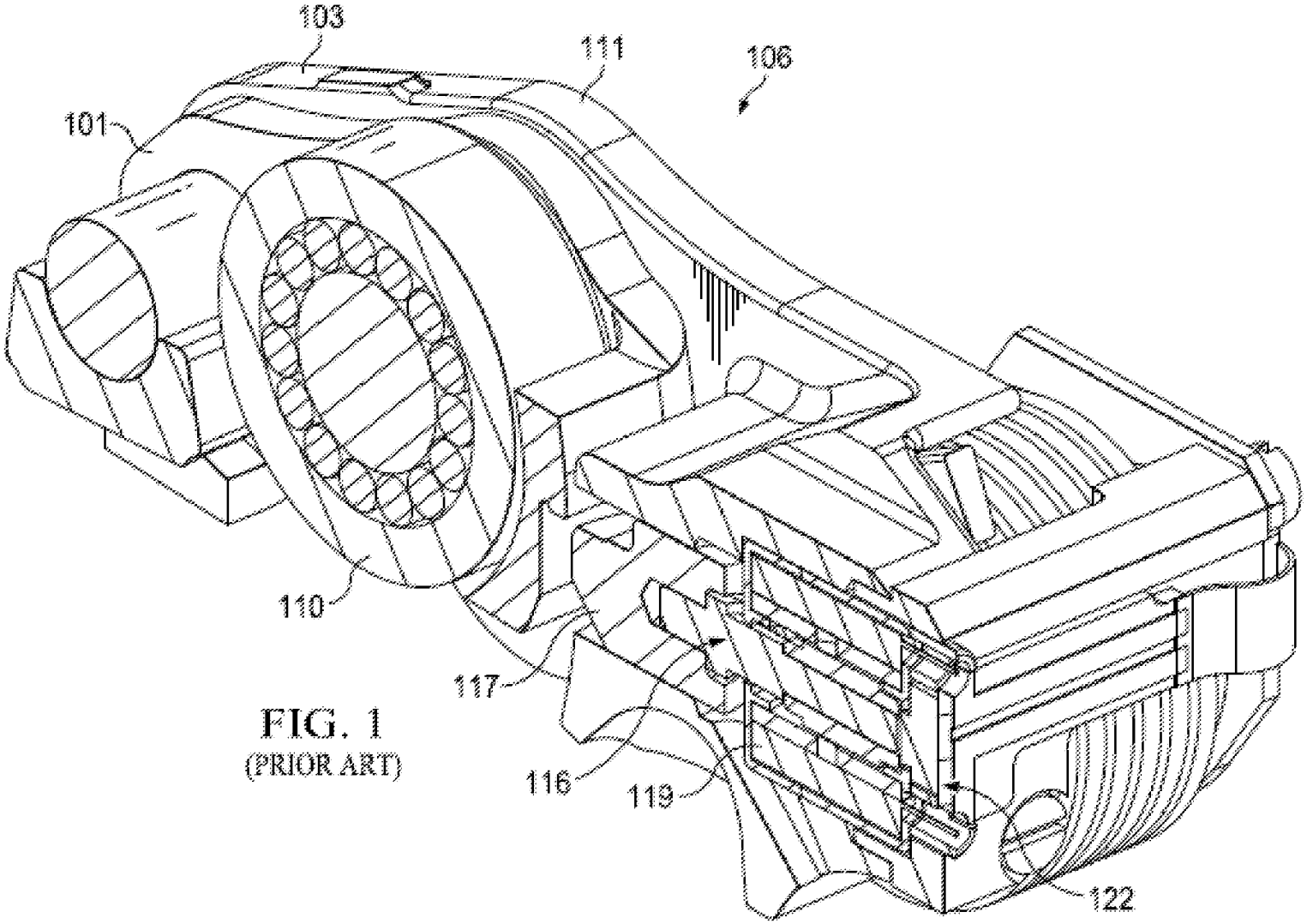
FIG. 1 (PRIOR ART)
FIG. 1 provides a perspective cutaway view of a rocker arm assembly.

FIG. 1 illustrates a rocker arm assembly 106 suitable for use in a valvetrain of an internal combustion engine of a type that has a combustion chamber, a moveable valve having a seat formed in the combustion chamber, and a camshaft. The rocker arm assembly 106 may be a switching rocker arm or may be used as a cylinder deactivating rocker arm. Rocker arm assembly 106 includes an inner arm 101, an outer arm 103, and cam follower 110 and 111. Cam follower 110 is a roller follower. Cam followers 111 are sliders. Rocker arm assembly 106 may be installed on a pivot such as a hydraulic lash adjuster and be driven by cams on a camshaft to actuate the moveable valve.

Rocker arm assembly 106 includes an electromagnetic latch assembly 122 that include an electromagnet 119, an armature 116, and a latch pin 117 that is coupled to armature 116. Armature 116 includes a ferrule 44, which is ferromagnetic or otherwise magnetically susceptible, and a paramagnetic core 45. The electromagnet 119 acts on armature 116 through the ferrule 44. The latch pin 117 selectively engages inner arm 101 and outer arm 103. Extending latch pin 117 engages inner arm 101 and outer arm 103. When inner arm 101 and outer arm 103 are engaged, a cam acting on cam follower 110 will actuate the moveable valve. Retracting latch pin 117 disengages inner arm 101 and outer arm 103. When inner arm 101 and outer arm 103 are disengaged, either the moveable valve will be actuated only by cams acting on cam followers 111, or the moveable valve will be deactivated.

Figure 2:
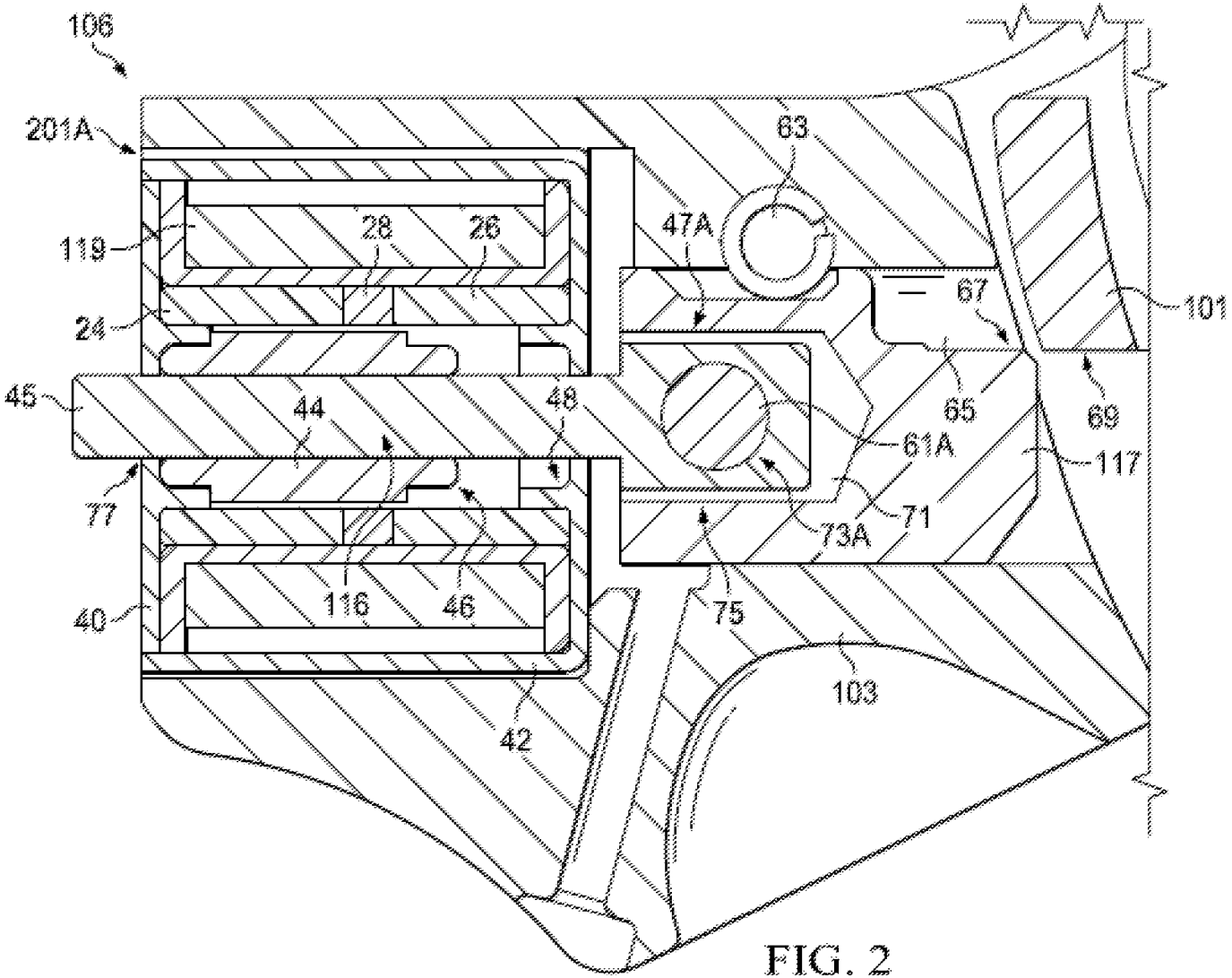
FIG. 2 provides a cutaway view of an electromagnetic latch assembly according to some aspects of the present teachings.

FIG. 2 illustrates rocker arm assembly 106 with an electromagnetic latch assembly 201A according to some aspects of the present teachings. Electromagnetic latch assembly 201A includes the electromagnet 119, the armature 116, and the latch pin 117. In electromagnetic latch assembly 201A, the armature 116 is coupled to the latch pin 117 through a bendable connection 47A. The electromagnet 119 is operative to produce forces on the ferrule 44 that cause the armature 116 to translate. Because of the coupling through the bendable connection 47A, this translation causes the latch pin 117 to also translate whereby the latch pin 117 may be moved between extended and retracted positions.

The electromagnetic latch assembly 201A further includes a permanent magnet 24 and a permanent magnet 26, each of which is operative to stabilize the position of armature 116 and therefore latch pin 117 in each of the extended and retracted positions. The permanent magnets 24 and 26 may be cylindrical and arranged with confronting polarities. In some embodiments, the permanent magnets 24 and 26 are separated by a pole piece 28, which may also be cylindrical. The pole piece 28 may have a slightly smaller diameter than the permanent magnets 24 and 26 to protect the permanent magnets 24 and 26 from contacting the armature 116.

The permanent magnets 24 and 26 utilize different magnetic circuits depending on whether the latch pin 117 is in the extended or the retracted position. A pole piece 40 and a pole piece 42 together form a clam shell around electromagnet 119, which completes some of these magnetic circuits. The ferrule 44 is within these magnetic circuits and is the part through which the permanent magnets 24 and 26 exert forces on the armature 116 and by extension the latch pin 117. The ferrule 44 has a stepped edge 46 that mates with a stepped edge 48 of the pole piece 42 as the latch pin 117 moves into the extended position. Forming these mating surfaces with the stepped edges 46 and 48 increases the magnitude of the magnetic forces that draw the latch pin 117 into the extended position over a range of latch pin travel.

For the purposes of this disclosure, a paramagnetic material is one that does not interaction strongly with magnetic fields. Aluminum is an example of a paramagnetic material. A magnetically susceptible material is generally a low coercivity ferromagnetic material. Soft iron is an example of a low coercivity ferromagnetic material. Pole pieces 28, 40, and 42 and ferrule 44 may all be made from soft iron.

As shown in FIG. 2, the latch pin 117 rides within a cylindrical bore 65 that is formed in the outer arm 103. The latch pin 117 may have a shelf 67 that may engage a lip 69 of the inner arm 101 when the inner arm 101 is actuated while the latch pin 117 is extended. The shelf 67 is a load-bearing surface. The latch pin 117 may have a generally cylindrical perimeter that conforms to the cylindrical bore 65 to within a certain clearance, but the shelf 67 is flat or nearly flat. An orientation pin 63 or other structure may fix an orientation of the shelf 67 and keep it parallel to the lip 69.

The bendable connection 47A is formed by a connecting pin 61A that pivotally connects the paramagnetic core 45 of the armature 116 with the latch pin 117. An end of the paramagnetic core 45 may fit within an opening 71 in the latch pin 117 that is large enough to provide a clearance 75 within which the latch pin 117 may pivot on the connecting pin 61A. The clearance 75 is sufficient to accommodate the pivoting undergone by the latch pin 117 within the bore 65 when the latch pin 117 is loaded by the inner arm 101. The pin 61A has an axis parallel to the shelf 67, parallel to the lip 69, and parallel to the orientation pin 63.

The paramagnetic core 45 extends through an opening 77 in a plate-shaped portion of the pole piece 40. The opening 77 is just beyond an end of electromagnet 119 that is opposite the bendable connection 47A and the latch pin 117. The paramagnetic core 45 is sufficiently long to remain within the opening 77 even when the latch pin 117 is fully extended. The pole piece 40 supports the paramagnetic core 45 and maintains concentricity of the armature 116 within the electromagnet 119. In some embodiments, the paramagnetic core has a d-shaped or other non-circular profile where it passes through the pole piece 40 and the opening 77 may have a mating profile, whereby the pole piece 40 prevents the rotation of the armature 116, which in turn prevents the rotation of the latch pin 117 and makes the orientation pin 63 unnecessary.

Figure 3:
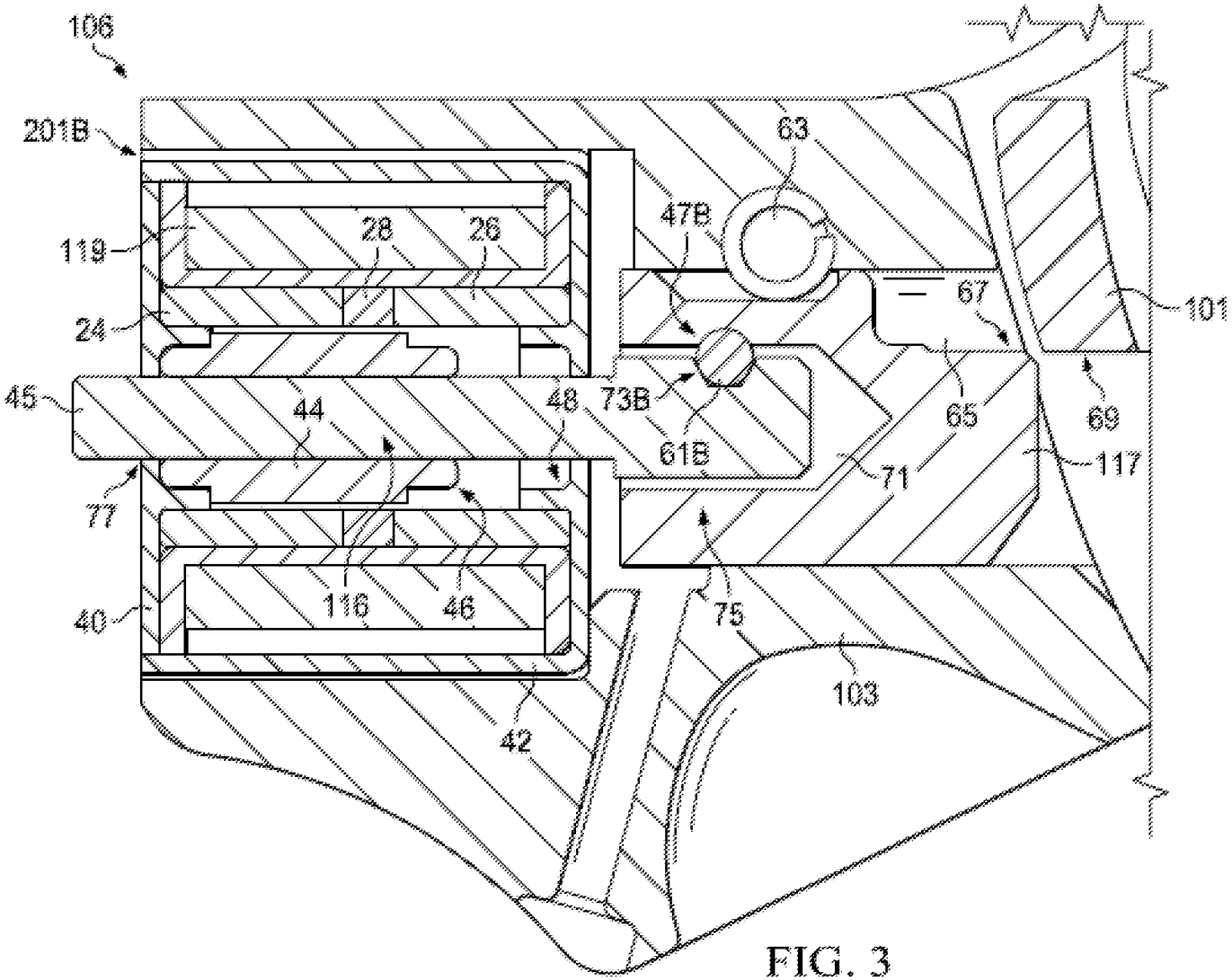
FIG. 3 provides a cutaway view of an electromagnetic latch assembly according to some aspects of the present teachings.

FIG. 3 illustrates the rocker arm assembly 106 with an electromagnetic latch assembly 201B according to another embodiment of the present disclosure. The electromagnetic latch assembly 201B is generally similar to electromagnetic latch assembly 201A, however, whereas the electromagnetic latch assembly 201A has the connecting pin 61A threading a bore 73A and crossing an axis of the armature 116, the electromagnetic latch assembly 201B has a connecting pin 61B that is offset from the axis of the armature 116. The connecting pin 61B anchors the armature 116 through a cutout 73B on an edge of paramagnetic core 45. The flexibility of being able to locate the connecting pin anywhere between the axis of the armature 116 and a peripheral location on the armature 116 may be used to locate the connecting pin near or on an axis on which the latch pin 117 pivots within the bore 65 when placed under load by the inner arm 101 or otherwise minimize any tendency of the latch pin 117 to drive the armature 116 off axis when placed under load.

Figure 4:
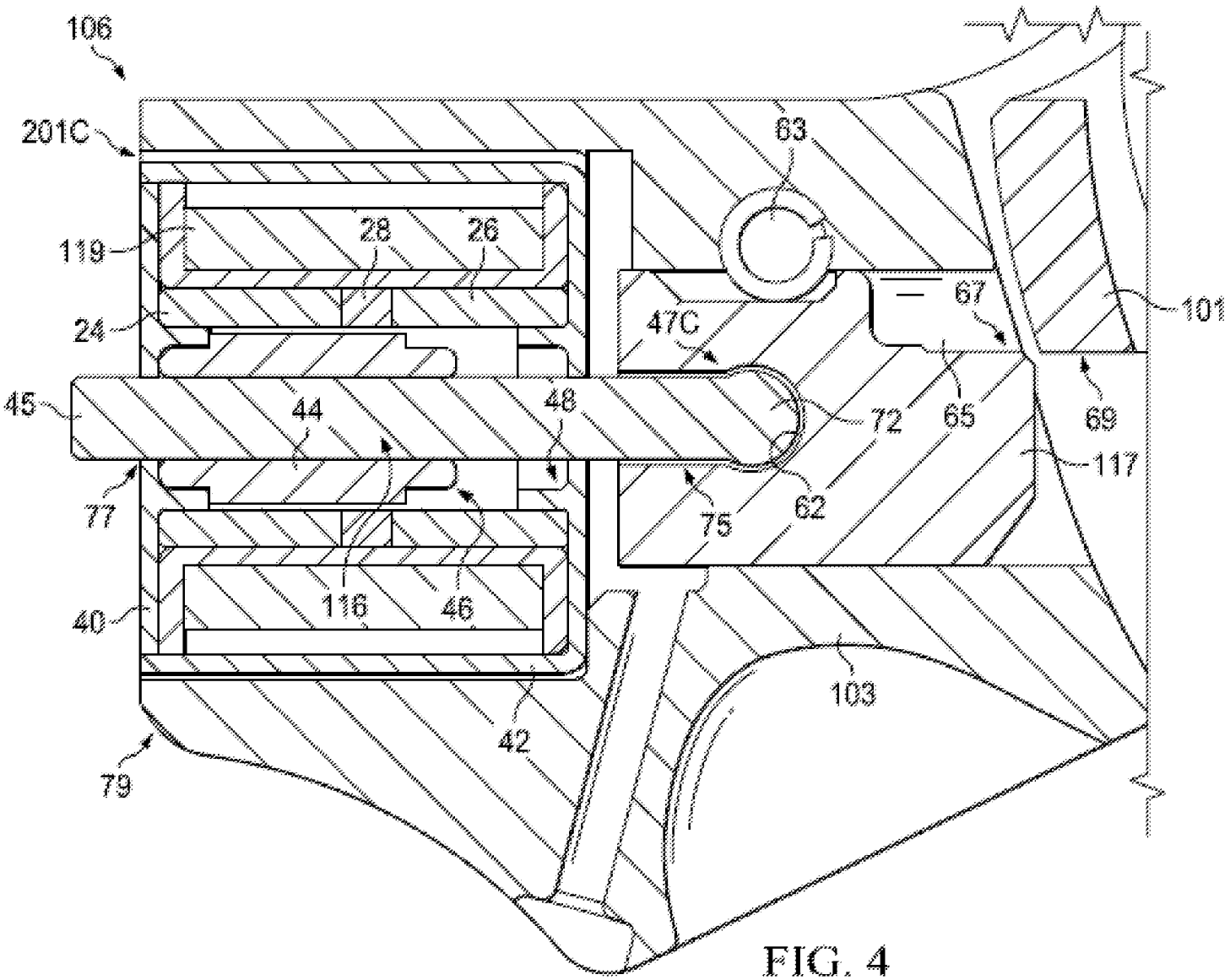
FIG. 4 provides a cutaway view of an electromagnetic latch assembly according to some aspects of the present teachings.

FIG. 4 illustrates the rocker arm assembly 106 with an electromagnetic latch assembly 201C according to another embodiment of the present disclosure. The electromagnetic latch assembly 201C is generally similar to the electromagnetic latch assembly 201A, except that electromagnet latch assembly 201C has a bendable connection 47C between the armature 116 and the latch pin 117 formed by a ball 62 on the end of the paramagnetic core 45 in a socket 72 formed within the latch pin 117. A bore may be formed through a side of the latch pin 117 to allow the ball 62 to be slid into the socket 72 during assembly. The bendable connection 47C provides several degrees of freedom for relative movement between the armature 116 and the latch pin 117. Portions of the electromagnetic latch assembly 201C may be fit within a bore 79 formed in the outer arm 103. Any misalignment between the bore 79 and the bore 65 may be matched by misalignment between the armature 116 and the latch pin 117. The bendable connection 47C accommodates this misalignment while transmitting translational forces from the armature 116 to the latch pin 117.

Figure 5:
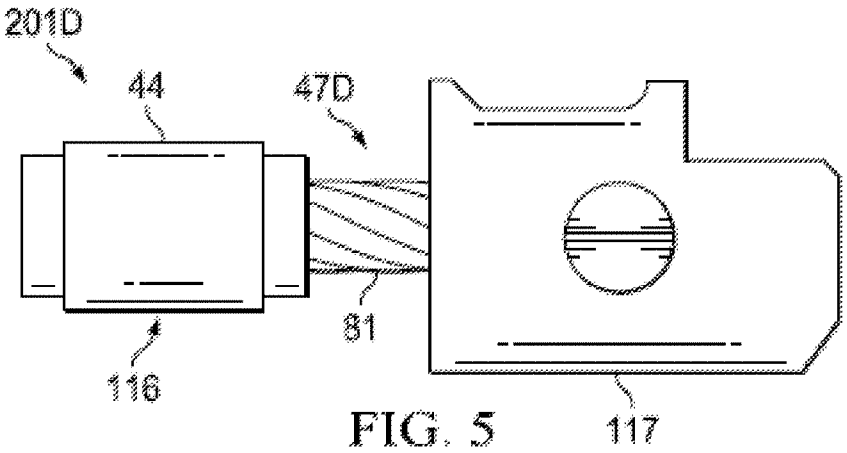
FIG. 5 provides a side view of an armature and a latch pin with a bendable connection according to some aspects of the present teachings.

FIG. 5 illustrates a portion of an electromagnetic latch assembly 201D according to another embodiment of the present disclosure. The electromagnetic latch assembly 201D may be used in place of the electromagnetic latch assembly 201C and has a bendable connection 47D between armature 116 and latch pin 117 that has multiple degrees of freedom. The bendable connection 47D is formed by a cable 81. Cable 81 may be paramagnetic and may be used in place of paramagnetic core 45.

Bendable connections 47A, 47B, 47C, and 47D all have the effect of reducing forces on armature 116 that could cause armature 116 to bend or stick. The following examples provide additional measures that may be used separately or in conjunction with any of those bendable connections to further reduce the possibility of bending or sticking.

Figure 6:
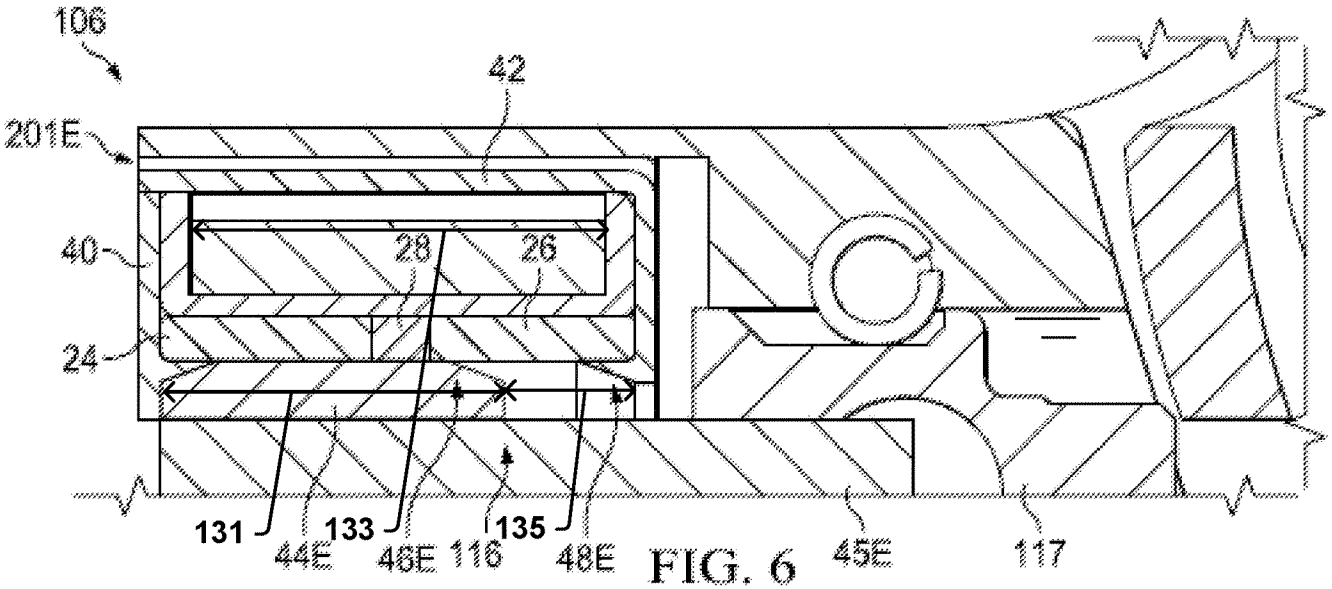
FIG. 6 provides a cutaway view of an electromagnetic latch assembly according to some aspects of the present teachings.

FIG. 6 illustrates the rocker arm assembly 106 with an electromagnetic latch assembly 201E. The electromagnetic latch assembly 201E has a ferrule 44E in which the stepped edge 46 of the ferrule 44 and the stepped edge 48 of the pole piece 42 have been replaced with a tapered edge 46E and a tapered edge 48E. The tapered edges 46E and 48E are more resistant to sticking than the stepped edges 46 and 48, particularly when off axis forces are applied to the armature 116.

Figure 7:
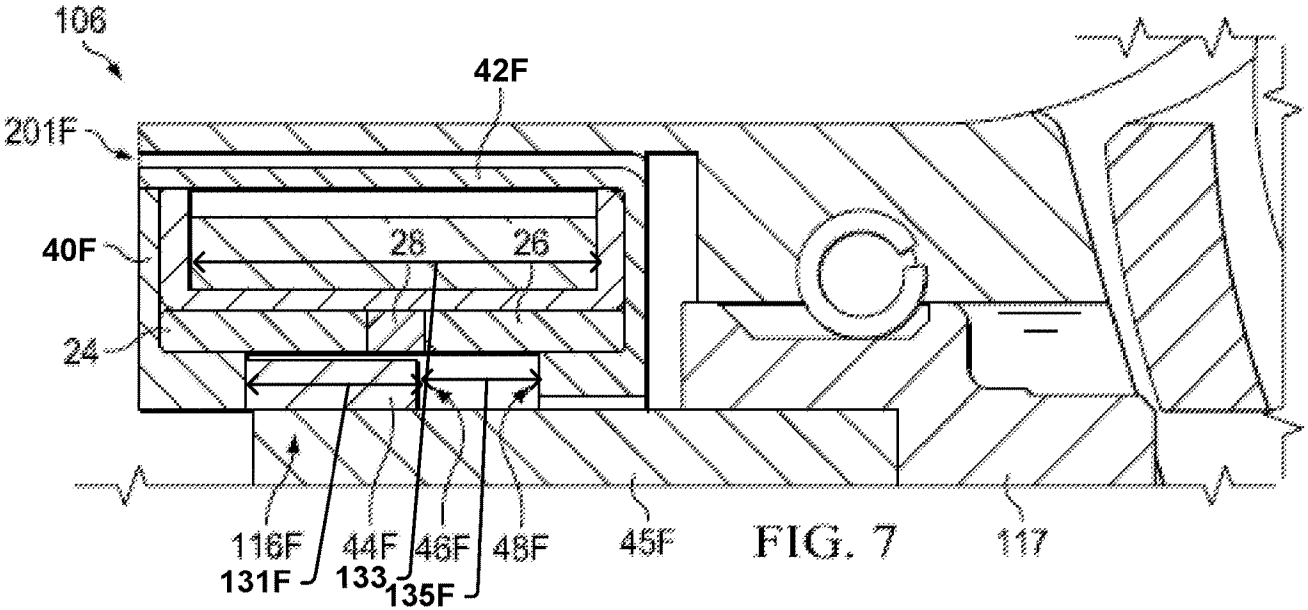
FIG. 7 provides a cutaway view of an electromagnetic latch assembly according to some of the present teachings.

FIG. 7 illustrates the rocker arm assembly 106 with an electromagnetic latch assembly 201F. The electromagnetic latch assembly 201F has a ferrule 44F in which the stepped edge 46 of the ferrule 44 and the stepped edge 48 of the pole piece 42 have been replaced with a flat face 46F and a flat face 48F. The flat faces 46F and 48F are more resistant to sticking than the stepped edges 46 and 48, particularly when off axis forces are applied to the armature 116F.

The armature 116F includes is shorter than the armature 116. The paramagnetic core 45F of the armature 116F is shorter than the paramagnetic core 45. Shortening the armature 116F reduces the loss of concentricity that occurs if armature 116F is tilted off axis. The ferrule 44F is shorter than the ferrule 44. While the ferrule 44F has been shortened, the pole piece 42F and the pole piece 40F have been extended toward one another within the electromagnet 119 in order to maintain the air gap size and keep the range of motion for the armature 116 and the latch pin 117 the same as in the other electromagnetic latch assemblies 201A-201E.

For the electromagnetic latch assemblies 201A-201E, a width 131 of a magnetically susceptible portion of the armature 116, which is the width of the ferrule 44 and of the ferrule 44E, plus a range of motion 135 for the armature 116 is greater than or approximately equal to a width 133 of the electromagnet 119. For the electromagnetic latch assemblies 201F, a width 131F of a magnetically susceptible portion of the armature 116F, which is the ferrule 44F, plus a range of motion 135F for the armature 116F is less the width 133 of the electromagnet 119. In some embodiments, the width 131F plus the range of motion 135F is at most three quarter of loss the width 133F. In some embodiments, the width 131F plus the range of motion 135F is about half the width 133F.

The paramagnetic core 45F is thicker than the paramagnetic core 45, which increases the resistance of the armature 116F to bending. Eliminating the pole piece 28 or replacing the pole piece 28 with a paramagnetic material may also reduce sticking. If the pole piece 28 is eliminated, the permanent magnets 24 and 26 may be moved closer together or even abutted.

Figure 8:
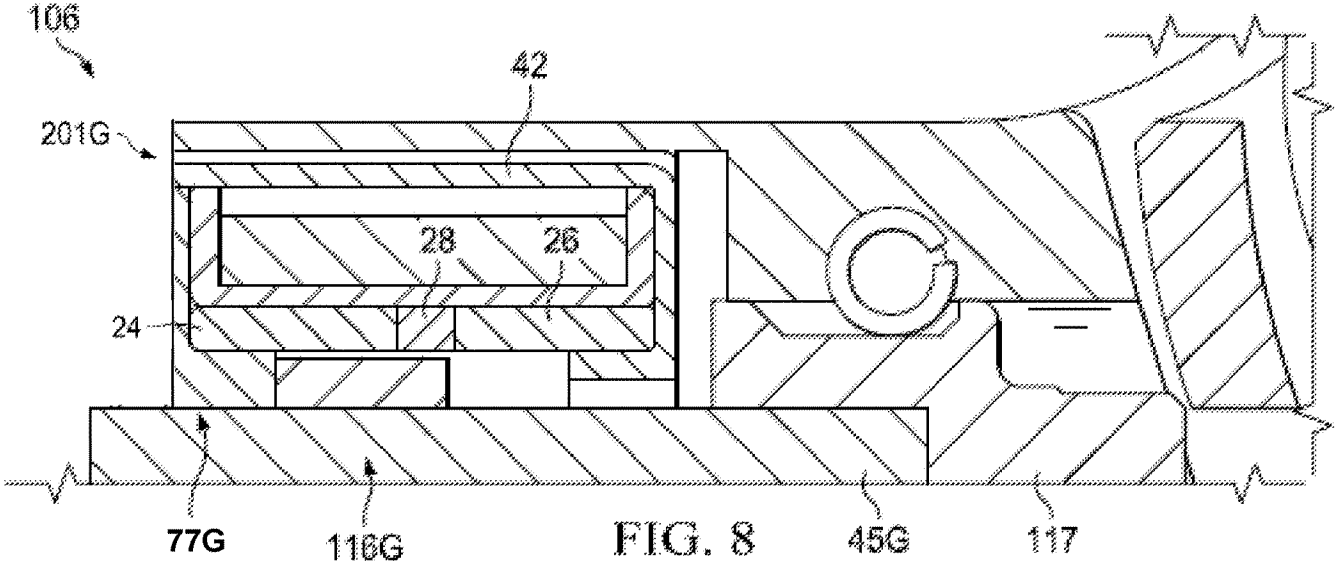
FIG. 8 provides a cutaway view of an electromagnetic latch assembly according to some aspects of the present teachings.

FIG. 8 illustrates the rocker arm assembly 106 with an electromagnetic latch assembly 201G. The electromagnetic latch assembly 201G is similar to the electromagnetic latch assembly 201F and has some of the same advantages including the shortened ferrule 44F, but has an armature 116G that is longer. A paramagnetic core 45G of the armature 116G is supported by an opening 77G in a pole piece 40F to maintain the alignment of the armature 116G.

Figure 9:
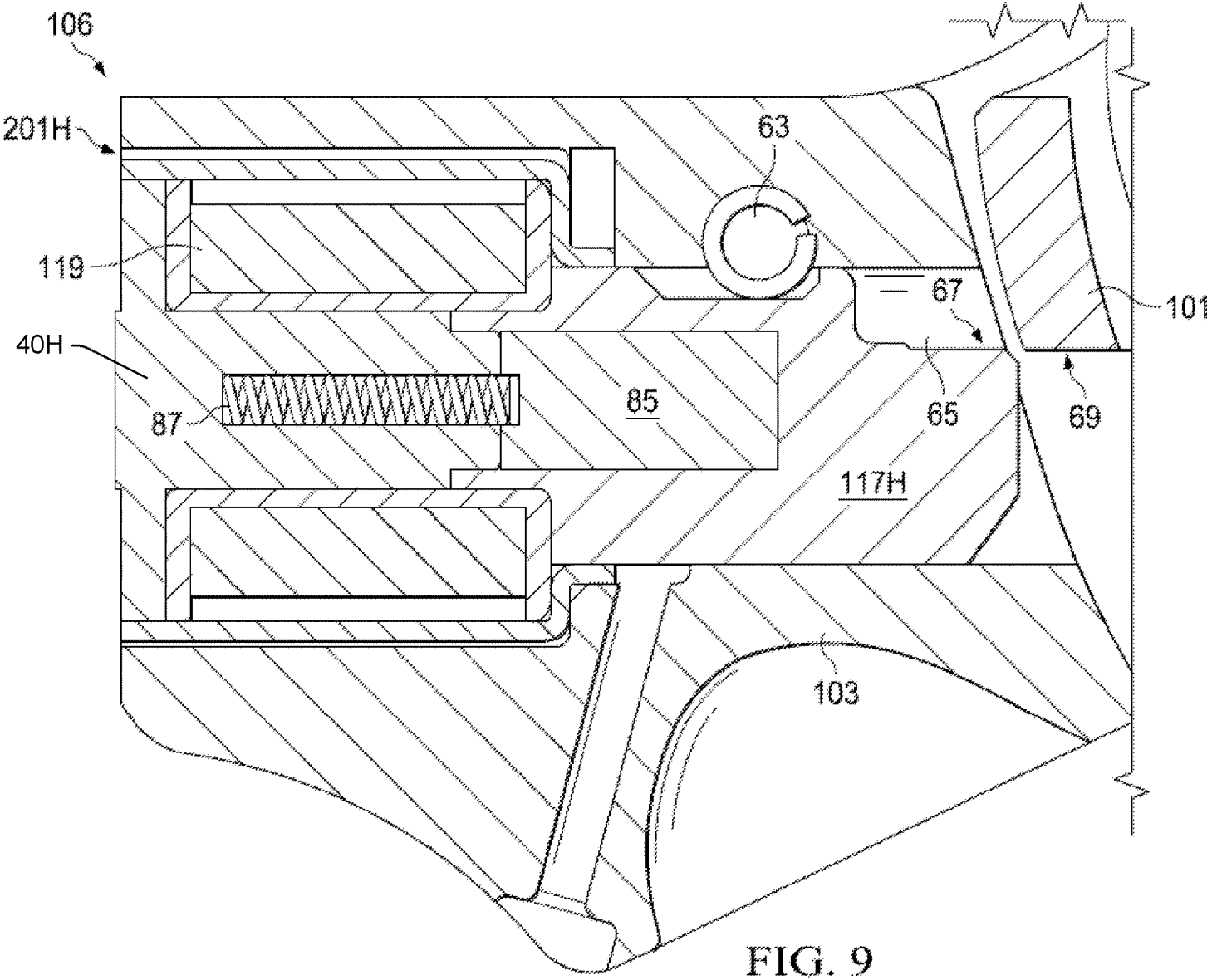
FIG. 9 provides a cutaway view of an electromagnetic latch assembly according to some aspects of the present teachings.

FIG. 9 illustrates the rocker arm assembly 106 with an electromagnetic latch assembly 201H. The electromagnetic latch assembly 201H is an example of an alternative concept having a latch pin 117H and no separate armature. Rather than an armature, the electromagnetic latch assembly 201H has a pole piece 40H that extends inside the electromagnet 119. The latch pin 117H is not rigidly attached to any armature and may pivot within the limits of the bore 65 without causing any alignment issue. A spring 87 holds the latch pin 117H in the extended position when the electromagnet 119 is without power. In some embodiments, the latch pin 117H includes a permanent magnet 85 that holds the latch pin 117H when the electromagnet 119 is without power. In other embodiments, the latch pin may be magnetically susceptible.

The components and features of the present disclosure have been shown and/or described in terms of certain embodiments and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A rocker arm assembly, comprising:

an electromagnetic actuator including an armature, the electromagnetic actuator operative to actuate the armature from a first position to a second position;

a latch pin; and a rocker arm wherein the latch pin and the electromagnetic actuator are mounted to the rocker arm; and wherein the latch pin is attached to the armature through a flexible connection.

2. The rocker arm assembly of claim 1, wherein the rocker arm includes a bore configured to guide the latch pin.

3. The rocker arm assembly of claim 1, wherein a diameter of the armature is less than a diameter of the latch pin.

4. The rocker arm assembly of claim 1, wherein the electromagnetic actuator is housed within the rocker arm.

5. The rocker arm assembly of claim 4, further comprising:

a plate adjacent an end of the electromagnetic actuator opposite the latch pin;

wherein the armature is supported by the plate.

6. The rocker arm assembly of claim 1, wherein the flexible connection restricts movement between the latch pin and the armature to a rotation about an axis.

7. The rocker arm assembly of claim 6, wherein the latch pin has a load-bearing surface parallel to the axis.

8. The rocker arm assembly of claim 6, wherein the latch pin has a shelf parallel to the axis.

9. The rocker arm assembly of claim 1, wherein the flexible connection comprises a ball and socket.

10. The rocker arm assembly of claim 1, wherein the flexible connection is a pivotal connection.

11. The rocker arm assembly of claim 1, wherein the flexible connection comprises a connecting pin that connects the latch pin to the armature.

12. The rocker arm of claim 11, wherein:

the armature has a central axis; and the connecting pin is arranged on the central axis.

13. The rocker arm assembly of claim 11, wherein:

the armature has a central axis; and the connecting pin is offset from the central axis.

14. The rocker arm assembly of claim 1, wherein the flexible connection comprises a cable that connects the latch pin to the armature.

15. The rocker arm assembly of claim 1, wherein:

the rocker arm includes a first bore and a second bore;

the first bore is configured to guide the latch pin along a path of translation; and the second bore contains the electromagnetic actuator.

16. The rocker arm assembly of claim 15, wherein:

the electromagnetic actuator is encased in a shell; and the shell is configured to guide the armature.

17. The rocker arm assembly of claim 1, wherein:

the electromagnetic actuator further includes an electromagnet and one or more permanent magnets; and the one or more permanent magnets make a position of the armature stable in the first position and the second position.

18. The rocker arm assembly of claim 17, wherein the one or more permanent magnets are located between the electromagnet and the armature.

19. The rocker arm assembly of claim 18, wherein the armature is spaced apart from the one or more permanent magnets.

20. A rocker arm assembly, comprising:

an electromagnetic actuator including an armature, the electromagnetic actuator operative to actuate the armature from a first position to a second position;

a latch pin attached to the armature through a flexible connection; and a rocker arm out of which the latch pin protrudes;

wherein the rocker arm houses the electromagnetic actuator and guides the latch pin.

* * * * *